US008397767B2

(12) United States Patent
Nagaoka

(10) Patent No.: US 8,397,767 B2
(45) Date of Patent: Mar. 19, 2013

(54) REINFORCING BAR BINDING MACHINE

(75) Inventor: Takahiro Nagaoka, Tokyo (JP)

(73) Assignee: Max Co., Ltd., Tokyo (JP)

( * ) Notice: Subject to any disclaimer, the term of this patent is extended or adjusted under 35 U.S.C. 154(b) by 930 days.

(21) Appl. No.: 12/467,444

(22) Filed: May 18, 2009

(65) Prior Publication Data

US 2009/0283170 A1 Nov. 19, 2009

(30) Foreign Application Priority Data

May 19, 2008 (JP) ..... 2008-130639

(51) Int. Cl.

| | |
|---|---|
| ***B65B 13/02*** | (2006.01) |
| ***B65B 13/28*** | (2006.01) |
| ***B21F 9/02*** | (2006.01) |
| ***B21F 9/00*** | (2006.01) |
| ***B21F 11/00*** | (2006.01) |
| ***B21F 99/00*** | (2009.01) |
| ***B21F 1/02*** | (2006.01) |

(52) U.S. Cl. ..... 140/93 R; 140/93.2; 140/93.4; 140/93 C; 140/93 D; 140/123.6; 140/139; 140/150

(58) Field of Classification Search ..... 140/1, 2, 140/74, 84, 93 R, 93.2, 93.4, 93 A, 93 C, 140/93 D, 113, 119, 123, 123.6, 139, 150, 140/111

See application file for complete search history.

(56) References Cited

U.S. PATENT DOCUMENTS

| | | | | |
|---|---|---|---|---|
| 4,534,817 | A * | 8/1985 | O'Sullivan | 140/93.2 |
| 5,824,984 | A * | 10/1998 | Morrow | 140/139 |
| 2005/0061389 | A1 * | 3/2005 | Nakagawa et al. | 140/119 |

FOREIGN PATENT DOCUMENTS

| | | |
|---|---|---|
| JP | 5-3494 | 1/1993 |
| JP | 2574259 | 3/1998 |
| JP | 3582411 | 8/2004 |
| WO | WO 2005/037490 A1 | 4/2005 |

* cited by examiner

*Primary Examiner* — Dana Ross
*Assistant Examiner* — Justin V Lewis
(74) *Attorney, Agent, or Firm* — Drinker Biddle & Reath LLP

(57) ABSTRACT

A reinforcing bar binding machine is provided with a pair of feed gears for feeding a wire from a wire reel mounted on a binding machine body; an electric motor for driving the feed gears; a partition plate provided between the feed gears and the electric motor to partition the feed gears and the electric motor; and first and second discharge portions for discharging wire shavings. The partition plate is surrounded by a wall except for portions of the partition plate being adjacent to the first and second discharge portions. The first and second discharge portions are disposed so that the partition plate positions between the first and second discharge portions.

4 Claims, 7 Drawing Sheets

REINFORCING BAR BINDING MACHINE

BACKGROUND OF THE INVENTION

1. Field of the Invention

The present invention relates to a reinforcing bar binding machine in which a wire is pulled out from a wire reel around which the reinforcing bar binding wire is wound in a housing chamber provided in a binding machine body, fed out to a circumference of reinforcing bars from a tip end of the binding machine body and wound around the reinforcing bars and then twisted to bind the reinforcing bars, wherein wire shavings accumulated around a wire feeding mechanism which pulls out the wire and feeds can be easily removed.

2. Background Art

In this type of reinforcing bar binding machine, a reinforcing bar binding wire is wound around a wire reel, and fed out to the tip end through a wire passage provided in the binding machine body. In the wire passage, a wire feeding device is provided. This feeding device includes a pair of feed gears disposed on both sides of the wire passage, and a wire is inserted between these feed gears, and by rotating the feed gears, the wire is fed out to the front side of the binding machine body (refer to JP-B2-3582411 and JP-Y2-2574259).

A wire feeding amount is calculated from the rotations of the feed gears, so that the rotations of the feed gears and the wire feeding amount must be in proportion to each other. For this, the contact friction between the peripheral surfaces of the feed gears and the wire is increased and the wire is fed. Accordingly, the feed gears are prevented from idling, and the wire can be reliably fed out.

On the other hand, the wire is curled by the guide part on the tip end of the binding machine body and looped at the leading end and wound around reinforcing bars, and then twisted, so that as the wire, a soft iron wire is used. The wire is coated with plastic for corrosion proofing. Therefore, when the feed gears are strongly pressed against this wire and rotated, the edges of the feed gears rub against the wire and shavings drop. The wire shavings are accumulated on a partition plate which partitions vertically the wire feed gears and an electric motor for driving the wire feed gears. Therefore, when the feed gears are used all day long, a large amount of wire shavings are accumulated. As a result, when a large amount of wire shavings become attached, this may cause an operation failure. Also, there is a possibility that the wire shavings enter a guide tube which guides the feeding of the wire and clog it.

Therefore, conventionally, accumulated wire shavings are blown and removed by air blow sometimes.

However, when using air blow, wire shavings are pushed into the inside of the binding machine body by the pressure of the air. Therefore, when the wire shavings are blown off, from a gap between the partition plate and the walls provided on the outer periphery of the partition plate, wire shavings may enter the inside of the binding machine body.

SUMMARY OF THE INVENTION

One or more embodiments of the invention provide a reinforcing bar binding machine in which wire shavings accumulated in a wire feeding device portion can be easily and reliably removed by air blow or a brush.

In accordance with one or more embodiments of the invention, a reinforcing bar binding machine is provided with: a pair of feed gears 9, 10 for feeding a wire 5 from a wire reel 4 mounted on a binding machine body 2; an electric motor 8 for driving the feed gears 9, 10; a partition plate 16 provided between the feed gears 9, 10 and the electric motor 8 to partition the feed gears 9, 10 and the electric motor 8; and first and second discharge portions 28, 29 for discharging wire shavings. The partition plate 16 is surrounded by a wall 18, 19 except for portions of the partition plate 16 being adjacent to the first and second discharge portions. The first and second discharge portions 28, 29 are disposed so that the partition plate 16 positions between the first and second discharge portions 28, 29.

In the above configuration, as a result of repetition of wire feeding by rotating the feed gears, inside the feed gear housing, wire shavings peeled off from the surface of the wire are scattered and accumulated. To remove the wire shavings, after the window cover is removed, air is blown to the inside of the feed gear housing by an air blower. In this case, air is blown from one discharge portion to the other discharge portion. The discharge portions are provided on mutually opposite sides of the partition plate, so that air is smoothly blown, and wire shavings are blown off and discharged to the outside from the other discharge portion. For portions other than the discharge portion, wire shavings are also collected to the discharge portions and removed in the same manner. Of course, the wire shavings can also be removed by a brush, etc. In every case, the wire shavings can be easily and reliably removed.

The discharge portions 28, 29 may be flush with a surface of the partition plate 16 in a side of the feed gears 9, 10. The discharge portions 28, 29 may be disposed in a side of the electric motor 8 than a surface of the partition plate 16 in a side of the feed gears 9, 10.

In the above configuration, the discharge portions are disposed at a height equal to or lower than the upper surface of the partition plate, so that the wire shavings can be discharged to the outside of the partition plate without resistance.

The partition plate 16 and the wall 18, 19 may be brought into contact with each other via a sponge-like sealing member 27 interposing therebetween.

In the above configuration, the partition plate and the wall are brought into contact with each other via a sponge-like sealing member, so that even if wire shavings are strongly blown off from the discharge portions, the partition plate and the walls are sealed, so that the wire shavings are prevented from entering the inside of the binding machine body. Therefore, the risk of breakage, etc., of the reinforcing bar binding machine is reduced.

The discharge portions 28, 29 may be capable of being opened and closed by a window cover 20 disposed on an upper portion of the partition plate 16.

In the above configuration, the discharge portions are normally closed by a window cover, so that dust can be prevented from entering the inside of the discharge portions from the outside.

Other aspects and advantages of the invention will be apparent from the following description, the drawings and the claims.

DESCRIPTION OF THE REFERENCE NUMERALS

5 Wire
9, 10 Feed gear
16 Partition plate
18, 19 Bulkhead (wall)
28, 29 Discharge portion

DETAILED DESCRIPTION OF THE EXEMPLARY EMBODIMENTS

An exemplary embodiment of the invention is described in reference to drawings.

Figure 1:
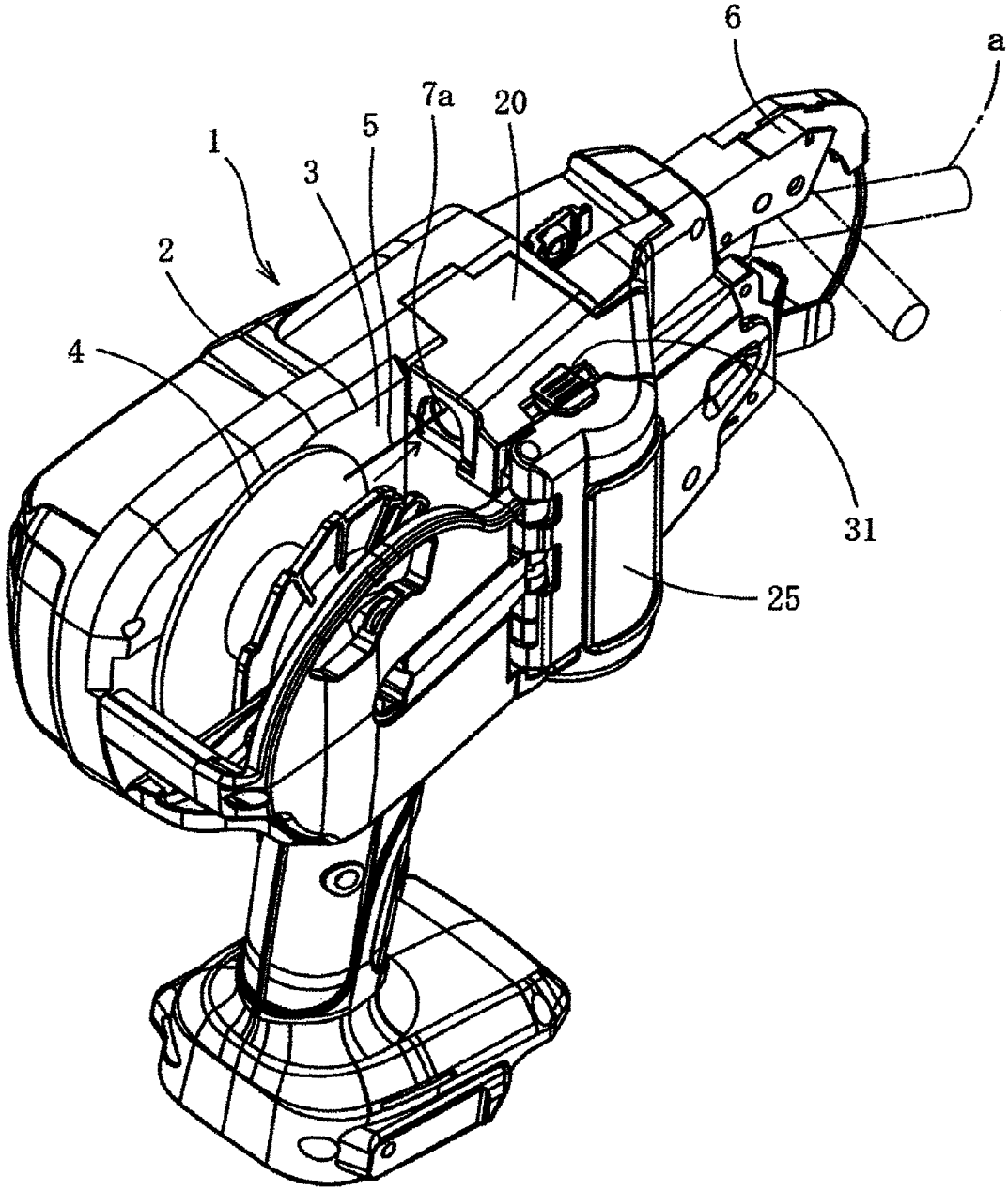
FIG. 1 is a perspective view of an essential portion of a reinforcing bar binding machine of an exemplary embodiment of the present invention.
Figure 2:
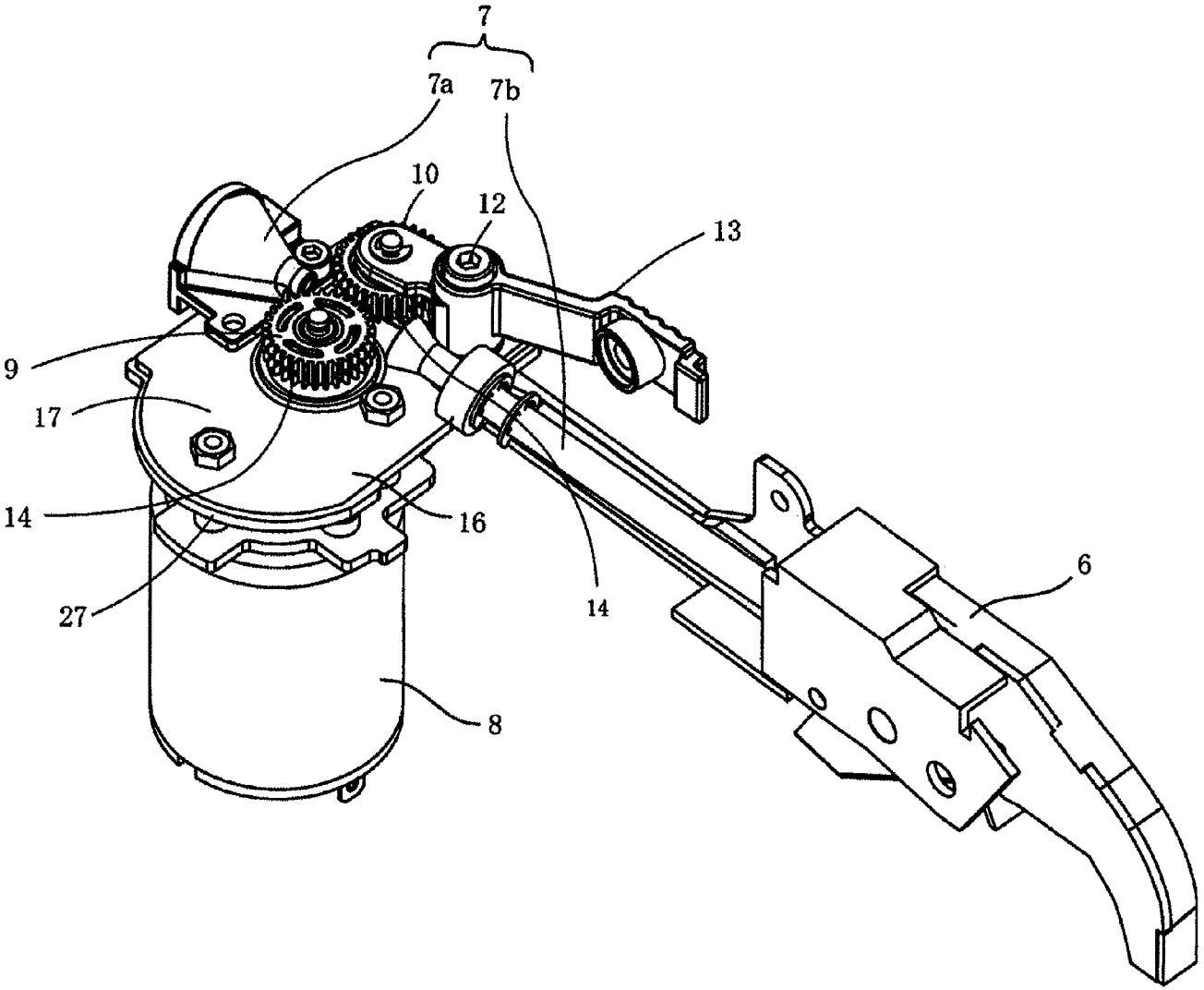
FIG. 2 is a perspective view showing a wire feeding device and a wire guide passage.
Figure 3:
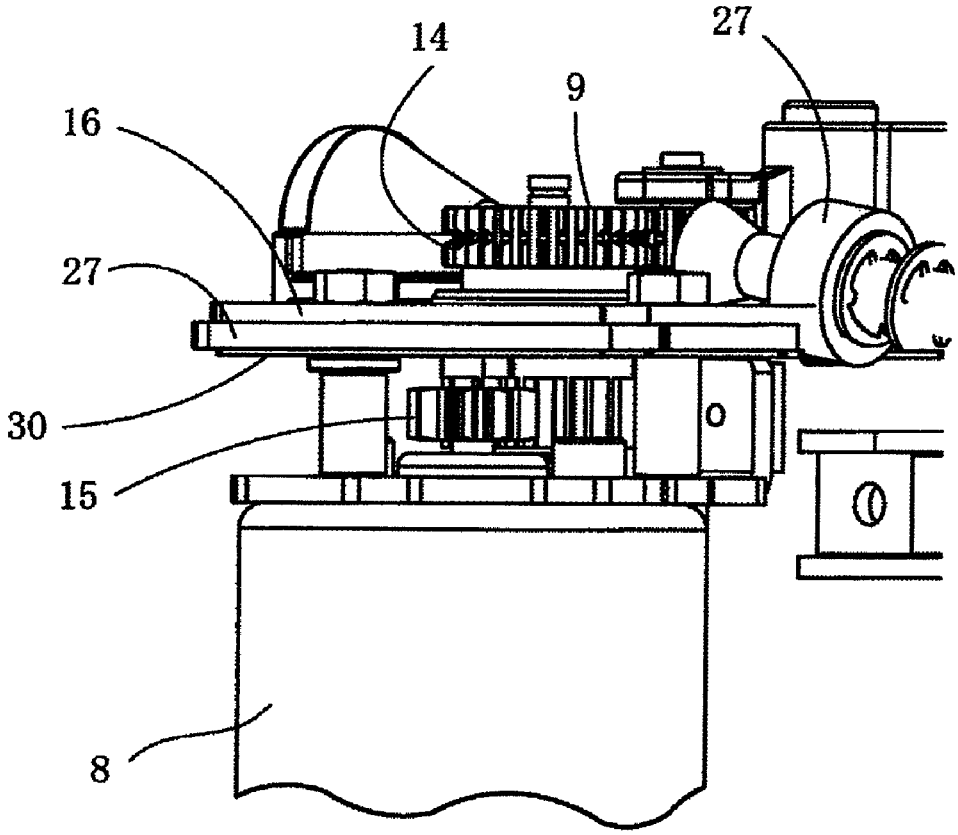
FIG. 3 is a side view of an essential portion of the wire feeding device.
Figure 4:
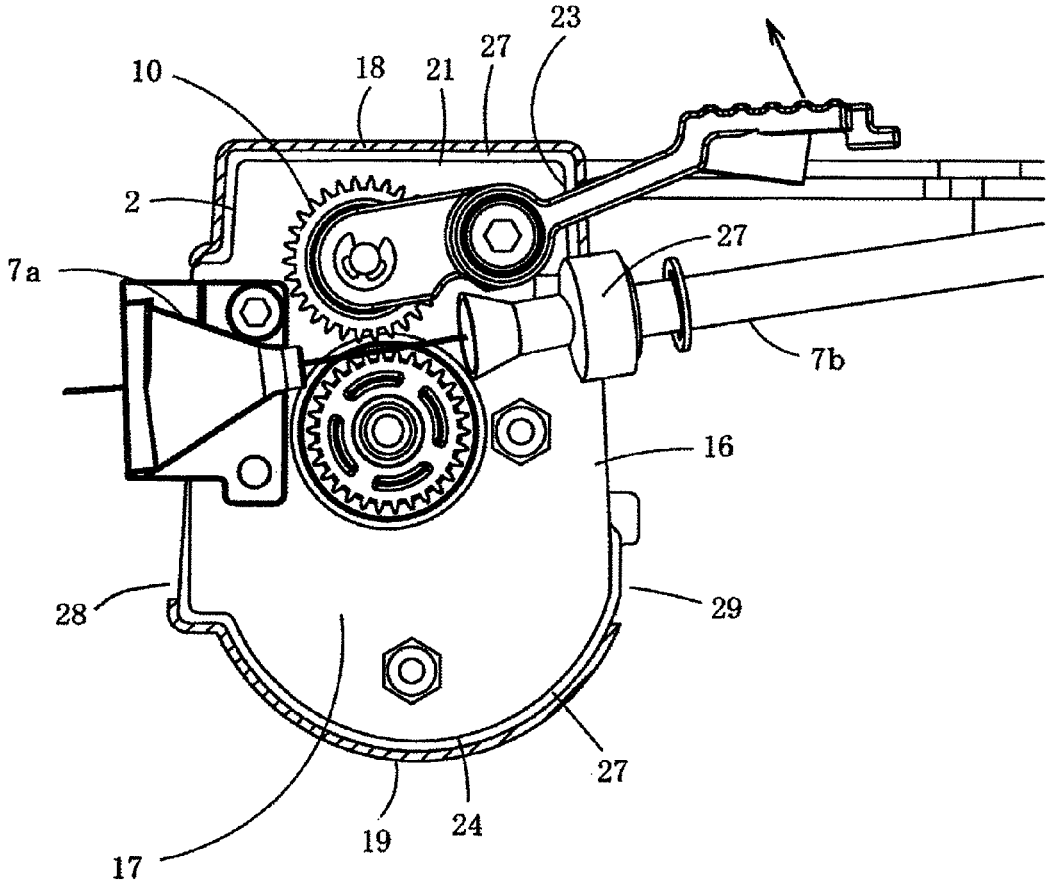
FIG. 4 is a plan view of the wire feeding device.

In FIG. 1 to FIG. 3, the reference numeral 1 denotes a reinforcing bar binding machine. In the reinforcing bar binding machine 1, in a housing chamber 3 provided in a binding machine body 2, a wire reel 4 around which a reinforcing bar binding wire 5 is wound is fitted, and a predetermined length of the wire 5 is fed to a guide part 6 provided on the tip end of the binding machine body 2 while rotating the wire reel 4, and the guide part 6 curls the wire 5 and feeds out the wire to the circumference of the reinforcing bars a disposed on the inner side of the guide part 6 and winds the wire around the reinforcing bars a, and then the root side of the wire 5 is cut, and the wound portion is twisted to bind the reinforcing bars a.

Between the housing chamber 3 and the guide part 6, a guide tube 7 through which the wire 5 is inserted is provided as shown in FIG. 2, and at the middle of the guide tube 7, a wire feeding device (described later) to be driven by an electric motor 8 is disposed. At the guide part 6, a wire cutting device and a wire twisting device are disposed although these are not shown. When a switch is turned ON by a trigger, the wire feeding device is actuated, and the wire 5 wound around the wire reel 4 housed in the housing chamber 3 is fed to the guide part 6 ahead of the binding machine body 2.

The guide part 6 curls the wire 5 so that the wire 5 fed into the binding machine body 2 is delivered while being curled, and curls the wire 5 and then winds it around the reinforcing bars a between the guide part and a lower guide 9. Then, after the wire 5 is wound around the reinforcing bars a, the wire is cut by a cutting device driven by another electric motor, and twisted by the twisting device to bind the reinforcing bars.

Actuations, etc., of the wire feed gears, the wire cutting device, and the wire twisting device are sequence-controlled by a control circuit not shown. The control circuit also measures the feeding amount of the wire 5.

The wire feeding device which pulls out the wire from the wire reel and feeds it to the guide part 6 includes, as shown in FIG. 2, the guide tube 7 constituting a wire passage, a pair of feed gears 9 and 10 disposed oppositely at the middle portion of the guide tube 7, and an electric motor 8 which drives the feed gears 9 and 10.

The guide tube 7 includes a conical introduction tube 7*a* which introduces the wire 5 pulled out from the wire reel, and a main guide tube 7*b* which guides the wire 5 fed-out by the feed gears 9 and 10 to the guide part 6.

One feed gear 9 is a drive gear and joined to the electric motor 8, however, the other feed gear 10 is a free gear and provided on one end of an arm 13 which turns around a shaft 12. The arm 13 is for spacing between the feed gears 9 and 10 and inserting the wire 5 therebetween, and applying a fixed pressing force to the wire 5 by pressing the other end of the arm 13 by a spring (not shown). On the outer peripheries of the feed gears 9 and 10, feed grooves 14 are formed, and the wire 5 is sandwiched between the feed grooves 14 of the two feed gears 9 and 10, and when the feed gears 9 and 10 rotate, the frictional forces between the feed grooves 14 and the wire 5 feed out the wire 5.

As shown in FIG. 2 and FIG. 3, the feed gears 9 and 10 are partitioned from the electric motor 8 and a reduction gear 15 of the electric motor 8 by the partition plate 16. Above the partition plate 16, the guide tube 7 and the pair of feed gears 9 and 10 for the wire 5 are disposed. These guide tube 7 and feed gears 9 and 10 are disposed at a deflected position on one side of the partition plate 16, and the other side portion 17 is an empty space.

Figure 5:
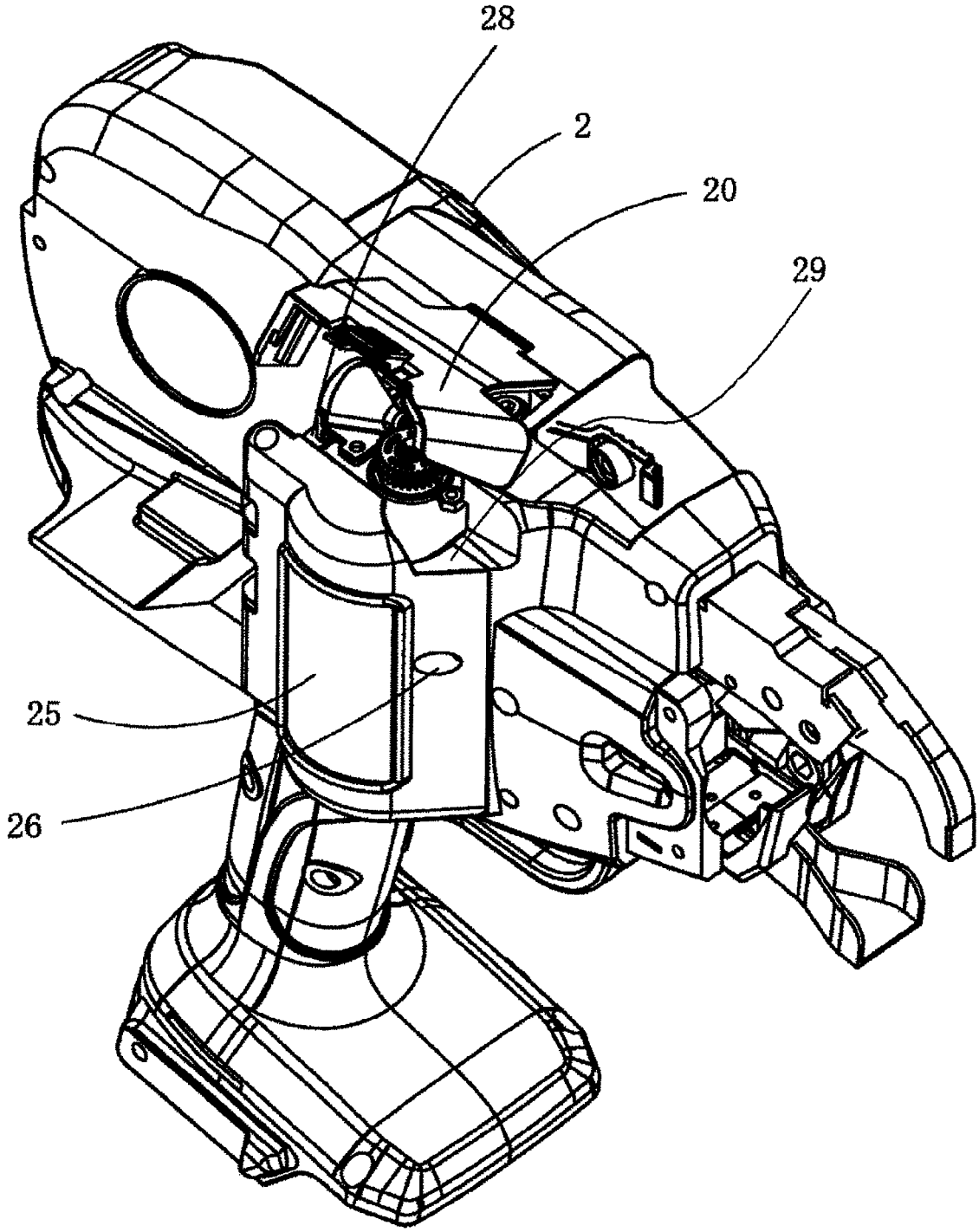
FIG. 5 is a perspective view of an essential portion of a reinforcing bar binding machine in a state where the window cover is opened.
Figure 6:
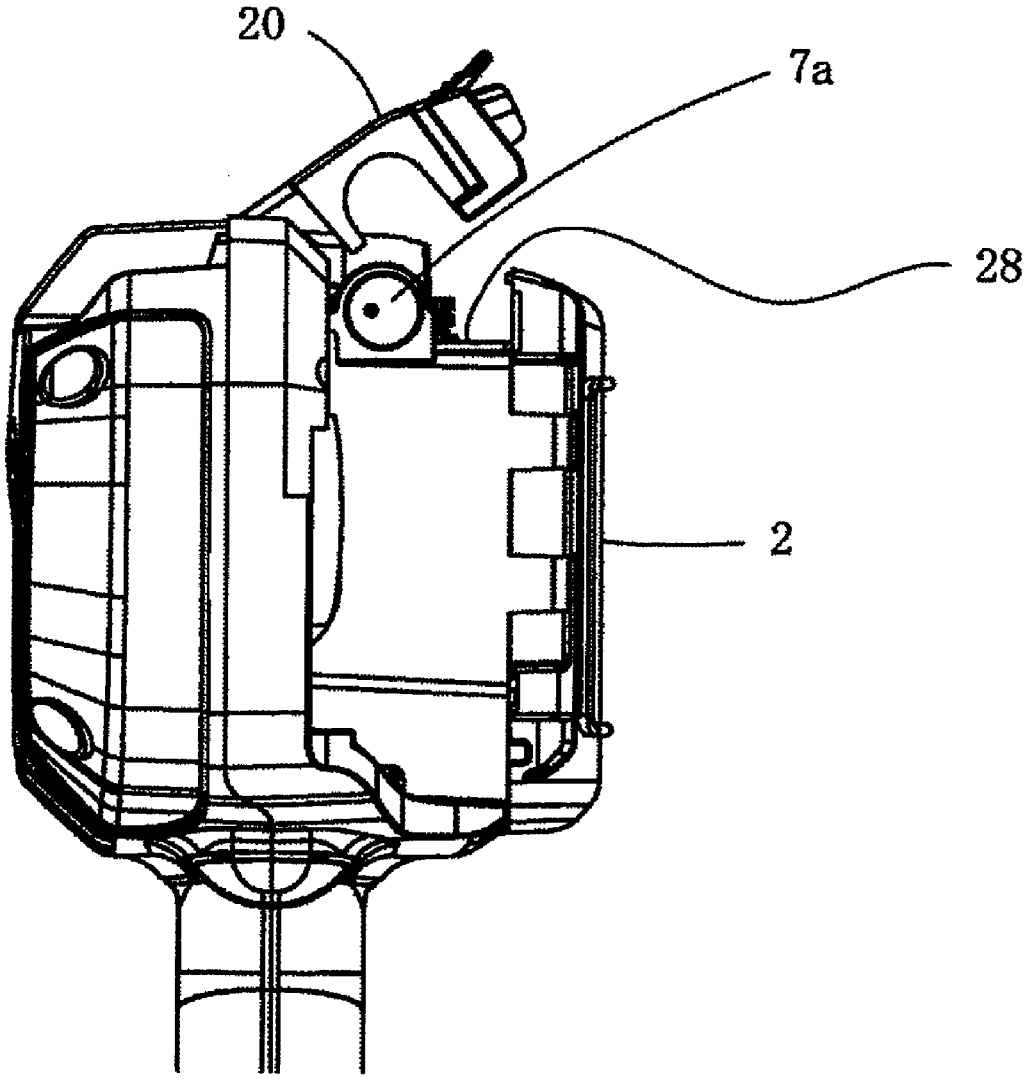
FIG. 6 is a back view of the essential portion of the reinforcing bar binding machine from the back side.
Figure 7:
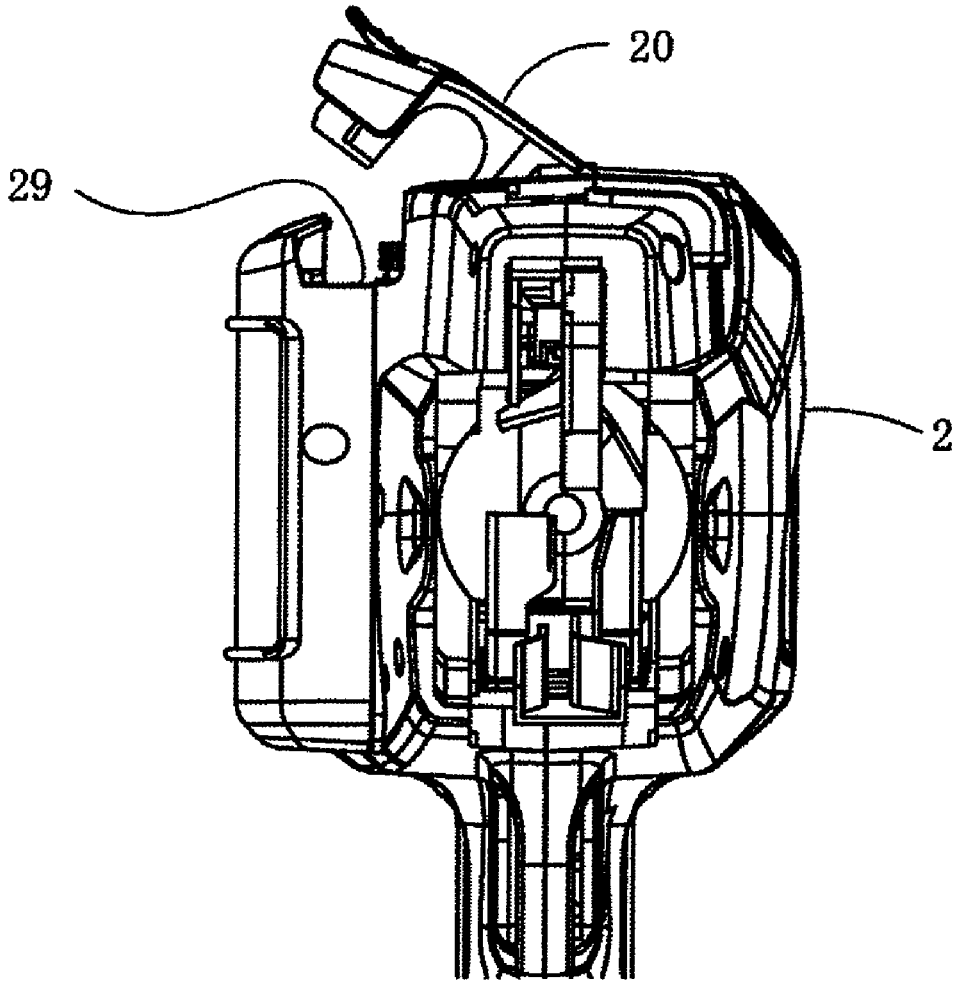
FIG. 7 is a front view of the essential portion of the reinforcing bar binding machine from the front side.

Next, most of the circumference of the partition plate 16 is covered by bulkheads 18 and 19, and the upper portion is covered by a window cover 20, and between the partition plate 16 and bulkheads 18 and 19 and the window cover 20, a feed gear housing is formed. In other words, the side 21 on the free gear 10 side of the partition plate 16, the side 22 closer to the free gear 10 side than the introduction tube 7*a*, and the half 23 on the main guide tube 7*b* side of the side on the main guide tube 7*b* side, are in contact with the bulkhead 18 provided on the binding machine body 2. In the empty space 17, the side 24 opposite to the free gear 10 is in contact with the inner wall of a door cover 25 covering a housing of the electric motor 8. The door cover 25 turns to open and close, and normally, it is fixed to the binding machine body by a screw 26 (see FIG. 5), and when maintenance is necessary, the door cover can be opened by removing the screw 26.

The partition plate 16 and the bulkheads 18 and 19 are in contact with each other via a sponge-like sealing member 27. At the portion at which the partition plate 16 comes into contact with the bulkheads, the sealing member 27 is disposed. The sealing member 27 is sandwiched and fixed between the partition plate 16 and a support plate 30 disposed below the partition plate. Therefore, the sealing member 27 is provided lower than the upper surface of the partition plate 16. However, it is also possible that the sealing member 27 is adhesively fixed to the peripheral surface of the partition plate 16 so as to become flush with the upper surface of the partition plate 16.

The sealing member 27 is also attached to the circumference of the main guide tube 7*b*.

Between the partition plate 16 and the bulkheads 18 and 19, the sealing member 27 is interposed, so that dust does not enter the housing of the electric motor 8 and the inside of the binding machine body 2.

In a front side and a rear side of the partition plate 16, discharge portions 28, 29 (first and second discharge portions 28, 29). Portions of the partition plate 16 adjacent to the discharge portions 28, 29 are not surrounded by the bulkheads 18, 19 (wall). That is, in two positions between the bulkhead 18 and the bulkheads 19, the discharge portions 28, 29 are formed. The front discharge portion 28 and the rear discharge portion 29 are disposed so that the partition plate 16 is positions between the front discharge portion 28 and the rear discharge portion 29. A portion between the front discharge portion 28 and the rear discharge portion 29 is a part of the empty space 17. On an upper surface of the partition plate 16, the portion adjacent to the front discharge portion 28 is continued straight to the portion adjacent to the rear discharge portion 29. In addition, the front discharge portion 28 and the rear discharge portion 29 are provided so as to be flush with the upper surface of the partition plate 16 (a surface in a side of the feed gears 9, 10) or in a lower position (in a side of the electric motor 8) than the upper surface of the partition plate 16.

The upper portion of the partition plate 16 is covered by a window cover 20. The window cover 20 is supported so as to turn up and down on the upper portion of the binding machine body 2, and accordingly, by opening the upper portion of the feed gear housing, a wire 5 of a new wire reel is inserted into the guide tube 7 or maintenance and cleaning are performed. As well as the upper portions of the bulkheads, the opening of the discharge portions is also formed so as to open and close. When the window cover 20 is closed, the window cover is elastically engaged by a stopper 31 on the tip end.

According to the configuration described above, as a result of repetition of feeding of the wire 5, wire shavings are scattered and accumulated inside the feed gear housing. To remove the wire shavings, after the window cover 20 is opened, air is blown to the inside of the feed gear housing by an air blower. In this case, air is blown from the rear discharge portion 29 to the front discharge portion 28. Accordingly, air is smoothly blown, and wire shavings are blown off and discharged to the outside from the discharge portion 28. The discharge portions 28 and 29 are provided at a height equal to or lower than the upper surface of the partition plate 16, so that wire shavings are blown off at one time without being accumulated in the housing of the feed gears 9 and 10. On an upper surface of the partition plate 16, the portion adjacent to the front discharge portion 28 is continued straight to the portion adjacent to the rear discharge portion 29, so that the air flow between the rear discharge portion 29 and the front discharge portion 28 is not interrupted. Further, by blowing air on the partition plate 16 by an air blower, wire shavings accumulated by the side of the bulkheads are blown off from the discharge portions. At this time, between the partition plate 16 and the bulkheads, the sealing member is disposed, so that even if wire shavings are strongly blown off, the wire shavings do not enter the housing of the motor 8 and the inside of the binding machine body. Of course, the wire shavings can be removed by a brush, etc. In every case, wire shavings can be easily and reliably removed.

While description has been made in connection with specific exemplary embodiment of the invention, it will be obvious to those skilled in the art that various changes and modification may be made therein without departing from the present invention. It is aimed, therefore, to cover in the appended claims all such changes and modifications falling within the true spirit and scope of the present invention.

INDUSTRIAL APPLICABILITY

The present invention is applicable to a wire feeding mechanism of a reinforcing bar binding machine.

What is claimed is:

1. A reinforcing bar binding machine comprising:

a pair of feed gears for feeding a wire from a wire reel mounted on a binding machine body;

an electric motor for driving the feed gears;

a partition plate provided between the feed gears and the electric motor to partition the feed gears and the electric motor; and first and second discharge portions for discharging wire shavings, wherein the partition plate is surrounded by a wall except for portions of the partition plate being adjacent to the first and second discharge portions, wherein the first and second discharge portions are disposed so that the partition plate is positioned between the first and second discharge portions, and wherein the partition plate and the wall are brought into contact with each other via a sealing member interposing therebetween.

2. The reinforcing bar binding machine according to claim 1, wherein the discharge portions are flush with a surface of the partition plate in a side of the feed gears.

3. The reinforcing bar binding machine according to claim 1, wherein the discharge portions are disposed in a side of the electric motor than a surface of the partition plate in a side of the feed gears.

4. The reinforcing bar binding machine according to claim 1, wherein the discharge portions are capable of being opened and closed by a window cover disposed on an upper portion of the partition plate.

* * * * *